US007971858B2

(12) United States Patent
Takahashi et al.

(10) Patent No.: US 7,971,858 B2
(45) Date of Patent: Jul. 5, 2011

(54) VARIABLE VENTURI CARBURETOR

(75) Inventors: Toshimasa Takahashi, Shiroishi (JP); Tamio Aihara, Shibata-Gun (JP); Jun Takano, Shibata-Gun (JP); Dairoku Suzuki, Kakuda (JP); Takeshi Sakaguchi, Natori (JP)

(73) Assignee: Walbro Engine Management, L.L.C., Tucson, AZ (US)

( * ) Notice: Subject to any disclaimer, the term of this patent is extended or adjusted under 35 U.S.C. 154(b) by 397 days.

(21) Appl. No.: 12/119,014

(22) Filed: May 12, 2008

(65) Prior Publication Data

US 2009/0184434 A1 Jul. 23, 2009

(30) Foreign Application Priority Data

Jan. 21, 2008 (JP) ..... 2008-010632

(51) Int. Cl.
*F02M 7/22* (2006.01)

(52) U.S. Cl. ..... 261/48; 261/50.1; 261/57; 261/59; 261/DIG. 12; 261/DIG. 38; 261/DIG. 56

(58) Field of Classification Search ..... 261/23.2, 261/23.3, 48, 50.1, 50.2, 51, 57, 59, 60, 63, 261/66, DIG. 12, DIG. 38, DIG. 56
See application file for complete search history.

(56) References Cited

U.S. PATENT DOCUMENTS

| | | | | | |
|---|---|---|---|---|---|
| 1,884,360 | A | * | 10/1932 | Sturm | 261/72.1 |
| 3,802,671 | A | * | 4/1974 | Klutho | 261/34.2 |
| 4,094,931 | A | * | 6/1978 | Karino | 261/23.3 |
| 4,096,211 | A | * | 6/1978 | Rameau | 261/23.2 |
| 4,139,583 | A | * | 2/1979 | Riley et al. | 261/65 |
| 4,174,361 | A | * | 11/1979 | Rollins | 261/41.4 |
| 4,185,054 | A | * | 1/1980 | Nakamura et al. | 261/44.4 |
| 4,190,032 | A | * | 2/1980 | Wright | 123/590 |
| 4,465,642 | A | * | 8/1984 | Nakamura et al. | 261/44.4 |
| 4,481,152 | A | | 11/1984 | Kobayashi et al. | |
| 4,530,805 | A | * | 7/1985 | Abbey | 261/53 |
| 5,599,484 | A | | 2/1997 | Tobinai | |
| 5,988,602 | A | * | 11/1999 | Yokoyama et al. | 261/35 |
| 6,003,845 | A | | 12/1999 | Kus | |
| 6,505,821 | B1 | * | 1/2003 | Edmonston | 261/44.3 |
| 6,672,570 | B2 | | 1/2004 | Takano et al. | |
| 2002/0113326 | A1 | | 8/2002 | Takano et al. | |
| 2006/0237858 | A1 | * | 10/2006 | Peterson | 261/51 |

FOREIGN PATENT DOCUMENTS

| | | | | | |
|---|---|---|---|---|---|
| JP | 53-012924 | | | 2/1978 | |
| JP | 54-25333 | A | * | 2/1979 | 261/DIG. 56 |
| JP | 57-193762 | A | * | 11/1982 | 261/DIG. 12 |
| JP | 58-101253 | | | 6/1983 | |
| JP | 58-113563 | A | * | 7/1983 | 261/DIG. 56 |

* cited by examiner

*Primary Examiner* — Richard L Chiesa
(74) *Attorney, Agent, or Firm* — Reising Ethington P.C.

(57) ABSTRACT

A carburetor includes a main body defining a bore, a main passage and a venturi defined within the bore, and a fuel nozzle carried by the main body and including a fuel nozzle outlet communicating with the venturi. The carburetor may also include a valve member translatable across an axis of the bore, such that in a closed state, the valve member closes the main passage but maintains the venturi at least partially open. The carburetor may also include a needle valve disposed at an end of the fuel nozzle substantially opposite of the fuel nozzle outlet to variably control flow of fuel into a fuel nozzle inlet, and a needle valve transmission may be coupled between a throttle shaft and the needle valve to convert rotation of the throttle shaft to translation of the needle valve.

26 Claims, 6 Drawing Sheets

VARIABLE VENTURI CARBURETOR

CROSS-REFERENCE TO RELATED APPLICATION

Applicants claim priority of Japanese Application, Ser. No. 2008-010632, filed Jan. 21, 2008, which is incorporated herein by reference in its entirety.

FIELD OF THE INVENTION

The present disclosure relates generally to carburetors for combustion engines, and more particularly to a variable venturi carburetor.

BACKGROUND OF THE INVENTION

Conventionally, there has been a demand to improve carburetors for cleaner exhaust gas, and various structures therefor have been proposed. Some carburetors comprise a sliding throttle valve in which a valve member is translatable to increase and decrease an open area of a fuel and air mixing passage. See, for example, Japanese Utility Model Application No. 51-94686 (Utility Model Application Publication No. 53-012924). It is disclosed in the above publication that in a lower-speed or small opening operation mode of a sliding throttle valve carburetor with a variable venturi, a negative intake pressure at the venturi tends to be larger compared with a butterfly valve carburetor. Such large pressure can make an air fuel mixture ratio overly rich and thereby cause unfavorable performance, unless a needle jet is used to restrict supply of fuel to the venturi.

To address this problem, the above publication proposes use of two separate main jets; one dedicated to the lower-speed mode, and another dedicated to a higher-speed or large opening operation mode. However, in the above publication a needle member is repeatedly moved into and out of a fuel nozzle jet, and abrasion may occur between the needle member and the jet after an extended period of use. Such abrasion can deteriorate the performance of the carburetor compared with its initial performance, and deterioration of fuel consumption efficiency and exhaust performances can be particularly significant in the lower-speed mode.

SUMMARY OF THE INVENTION

A carburetor according to one implementation includes a main body defining a bore extending through the main body along an axis, a main passage and a venturi defined within the bore, and a fuel nozzle carried by the main body and including a fuel nozzle outlet in fluid communication with the venturi. The carburetor also includes a valve member translatable with respect to the axis of the bore of the main body to control an open area of the bore, such that in a closed state, the valve member closes the main passage but maintains the venturi at least partially open to allow an amount of air for engine idling to flow therethrough.

According to another implementation, a carburetor includes a main body defining a bore extending through the main body along an axis, a main passage and a venturi defined within the bore, and a throttle shaft carried by the main body. The carburetor also includes a fuel bowl carried by the main body and defining a fuel reservoir, a fuel nozzle carried by the main body and including a fuel nozzle inlet in fluid communication with the fuel reservoir and a fuel nozzle outlet in fluid communication with the venturi. The carburetor further includes a needle valve disposed at the fuel nozzle inlet to variably control flow of fuel through the fuel nozzle inlet, and a needle valve transmission coupled between the throttle shaft and the needle valve to convert rotation of the throttle shaft to translation of the needle valve to adjust an amount of fuel supply.

According to an additional implementation, a carburetor includes a main body defining a bore extending along an axis, a throttle shaft carried by the main body, and a fuel nozzle carried by the main body. The carburetor also includes a needle valve operatively coupled to the fuel nozzle to variably control flow of fuel through the fuel nozzle, and a needle valve transmission coupled between the throttle shaft and the needle valve to convert rotation of the throttle shaft to translation of the needle valve. The transmission includes a cam coupled to the throttle shaft and having a cam surface that at least partially defines a variable air-fuel ratio supplied by the carburetor.

According to a further implementation, a sliding throttle valve carburetor includes a carburetor main body defining an intake bore, a valve member moveable in a direction of a diameter of the intake bore to increase and decrease an open area of the intake bore, and a venturi disposed in the intake bore and having a flow passage narrower than the intake bore. The carburetor also includes a fuel discharge port that opens into the flow passage of the venturi, wherein the valve member is integrally provided with a wall portion such that the wall portion moves with the valve member to open and close openings of the venturi, where the wall portion is disposed so as to move in slidable contact with end surfaces of the venturi defining the openings.

At least some of the objects, features and advantages that may be achieved by at least certain embodiments of the invention include providing a variable venturi carburetor that is less susceptible to deterioration of mileage and exhaust performance after an extended period of use, provides highly accurate fuel supply adjustment with a simple structure, improves fuel vaporization, fuel consumption efficiency, and exhaust characteristics, eliminates inadvertent fluctuation in a fuel flow rate through a jet needle structure, improves precision in fuel flow rate adjustment, allows easy adjustment of the fuel flow rate even after assembly of the apparatus, and is of relatively simple design, economical manufacture and assembly, rugged, durable, reliable, and in service has a long useful life.

Of course, other objects, features and advantages will be apparent in view of this disclosure to those skilled in the art. Various other carburetors embodying the invention may achieve more or less than the noted objects, features or advantages.

BRIEF DESCRIPTION OF THE DRAWINGS

These and other objects, features and advantages will be apparent from the following detailed description of exemplary embodiments and best mode, appended claims, and accompanying drawings in which:

DETAILED DESCRIPTION OF EXEMPLARY EMBODIMENTS

Figure 1A:
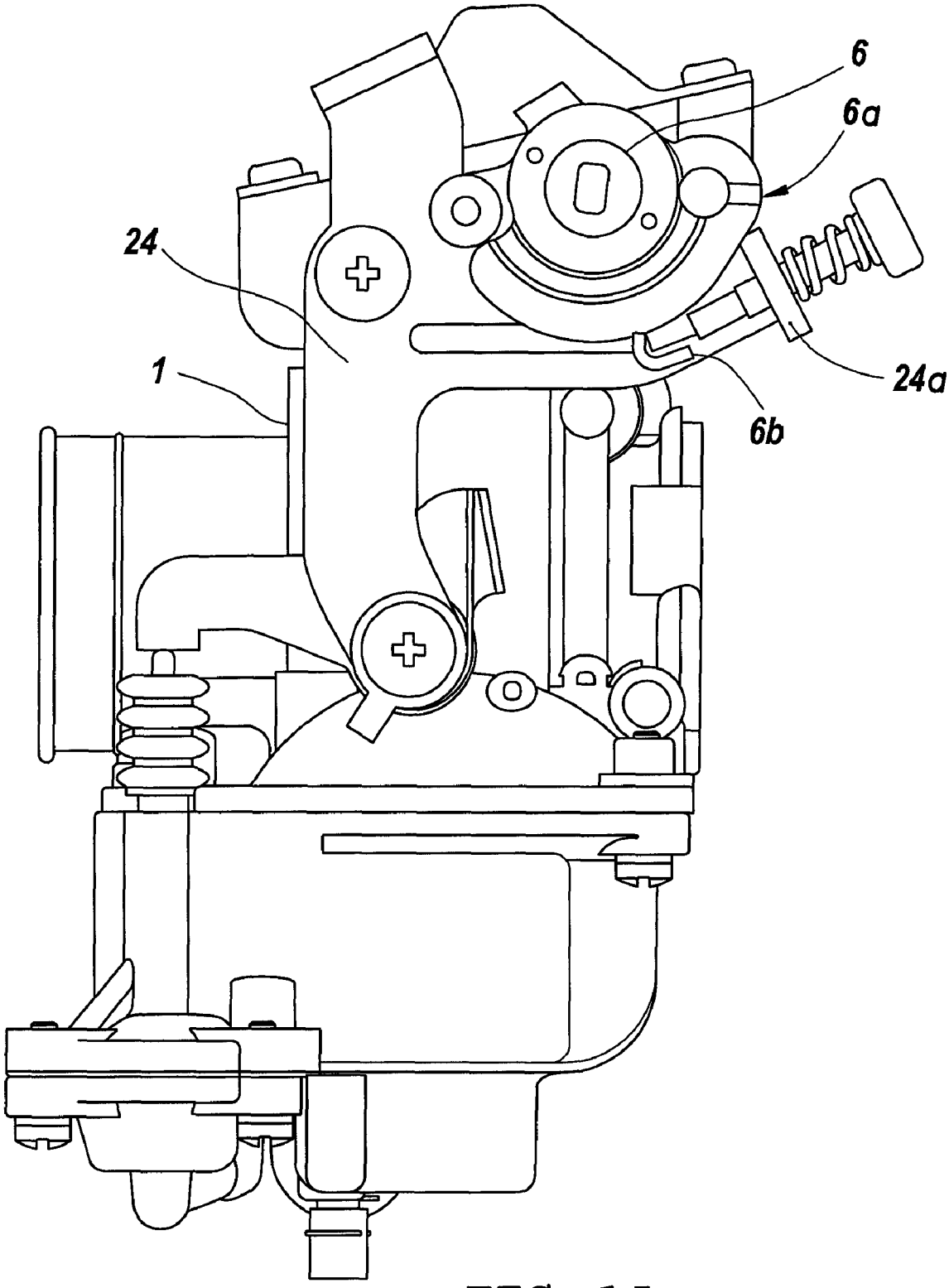
FIG. 1A is a side elevational view of an exemplary form of a sliding throttle valve carburetor.
Figure 1B:
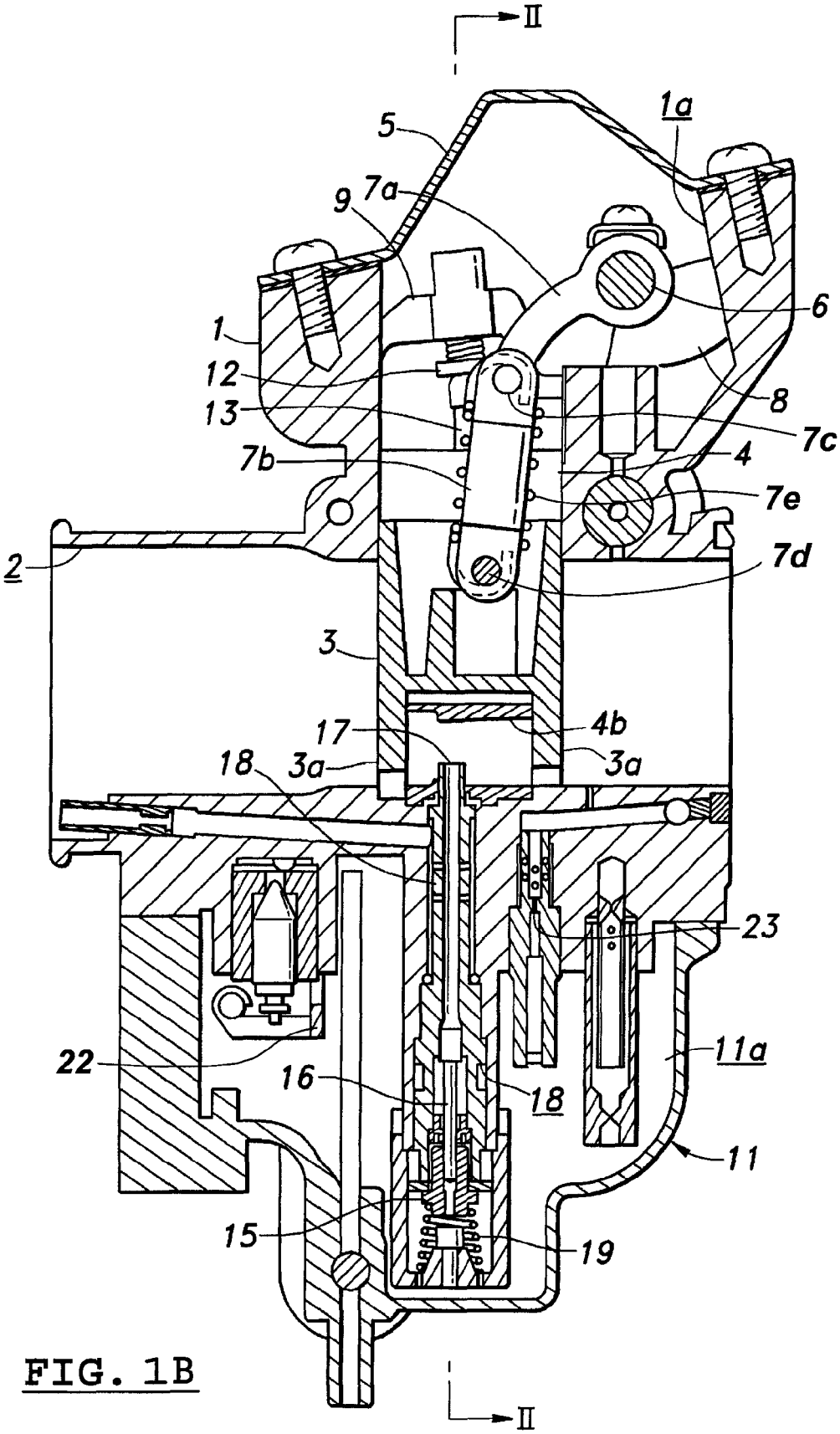
FIG. 1B is a side cross-sectional view of the sliding throttle valve carburetor of FIG. 1A.

Referring in more detail to the drawings, FIG. 1B illustrates an exemplary carburetor main body 1 formed with a fuel and air mixing passage or intake bore 2 extending therethrough in a horizontal direction of FIG. 1B. A valve member 3 is translatably disposed transversely across an intermediate part of the intake bore 2 to constitute a sliding throttle valve.

Figure 3:
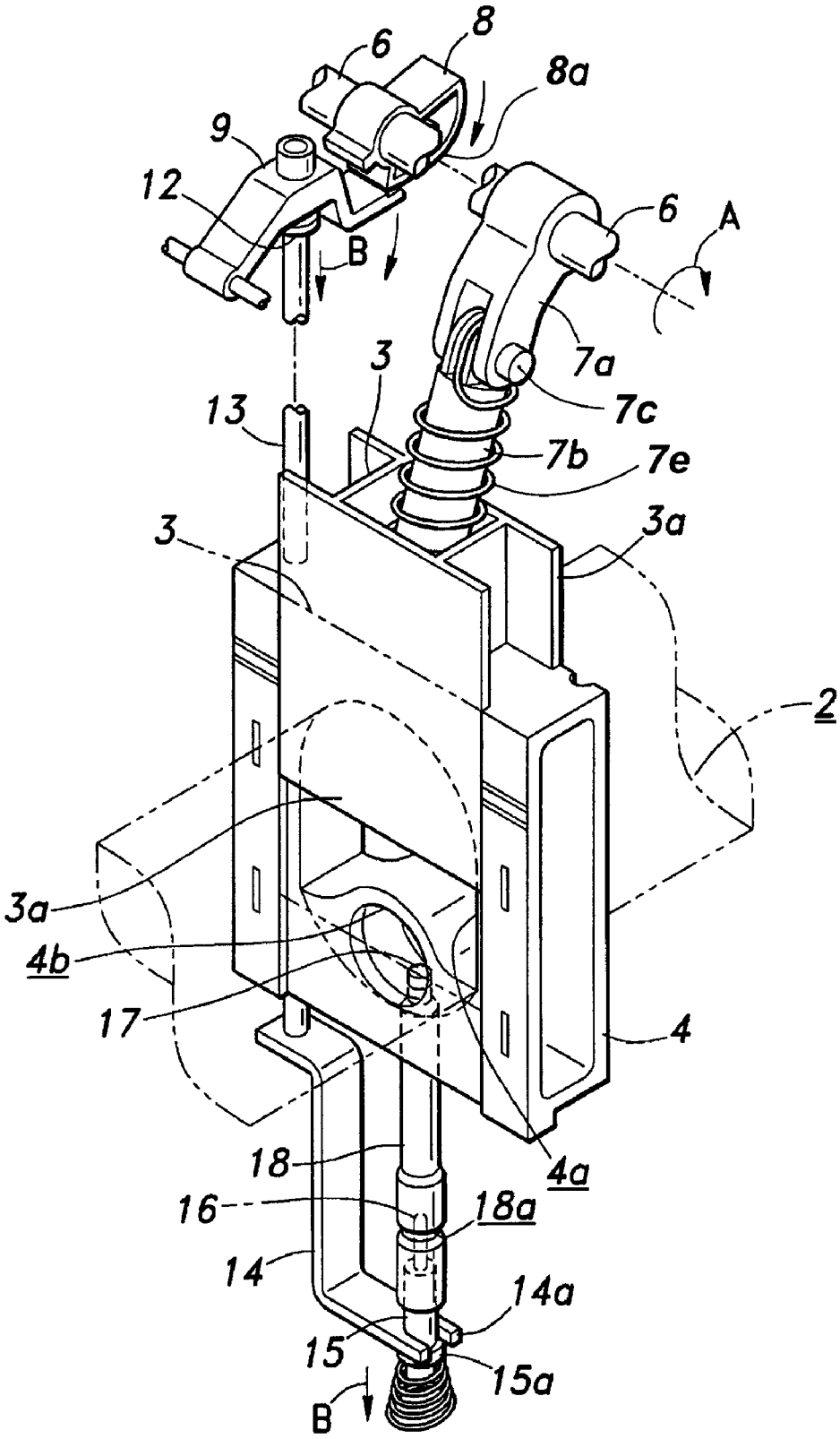
FIG. 3 is a perspective view showing a valve member and a variable fuel jet structure.

As shown in FIG. 3, the valve member 3 may include a pair of mutually opposed flat plate portions 3*a* serving as a wall portion, and the flat plate portions 3*a* are connected to each other by a pair of walls whereby the valve member 3 has a generally H-shaped cross-section with a hollow center. The valve member 3 may instead include a single plate or valve head. The flat plate portions 3*a* of the valve member 3 are supported by a valve member guide block 4, which may be of generally rectangular shape such that the flat plate portions 3*a* are moveable in a direction along a principal surface of the flat plate portions 3*a*.

The valve member guide block 4 is disposed so as to cross the intake bore 2 in a vertical direction, and is formed with a main intake passage 4*a* and a venturi 4*b*, each of which extends through the guide block 4 in an axial direction along the intake bore 2. The main intake passage 4*a* and the venturi 4*b* are opened and closed with respect to the intake bore 2 by movement of the valve member 3. In FIG. 3, the valve member 3 is shown in a half-opened state. In a fully-closed state, the main intake passage 4*a* is fully closed but the venturi 4*b* is kept open with such an open area that just allows an amount of air required for engine idling to flow therethrough. The venturi 4*b* may be of any suitable shape. For example, the venturi 4*b* may include a parabolic shaped passage or a substantially cylindrical or constant diameter passage that communicates at each end with the larger bore 2.

In the illustrated embodiment, the valve member 3 assumes a generally H-shaped cross-section including the pair of flat plate portions 3*a* for opening and closing openings at both ends of the venturi 4*b*, but the shape of the portions of the valve member 3 for opening and closing the openings of the venturi 4*b* is not limited to the flat plate shape and may assume, for example, a generally circular outer profile in a plan view when viewed in a direction of opening and closing movement of the valve member 3. In the case that the valve member 3 has a circular outer profile, the valve member supporting portion of the valve member guide block 4 can be formed as a circular hole, and this can make the manufacture of the valve member guide block 4 easier.

Figure 2:
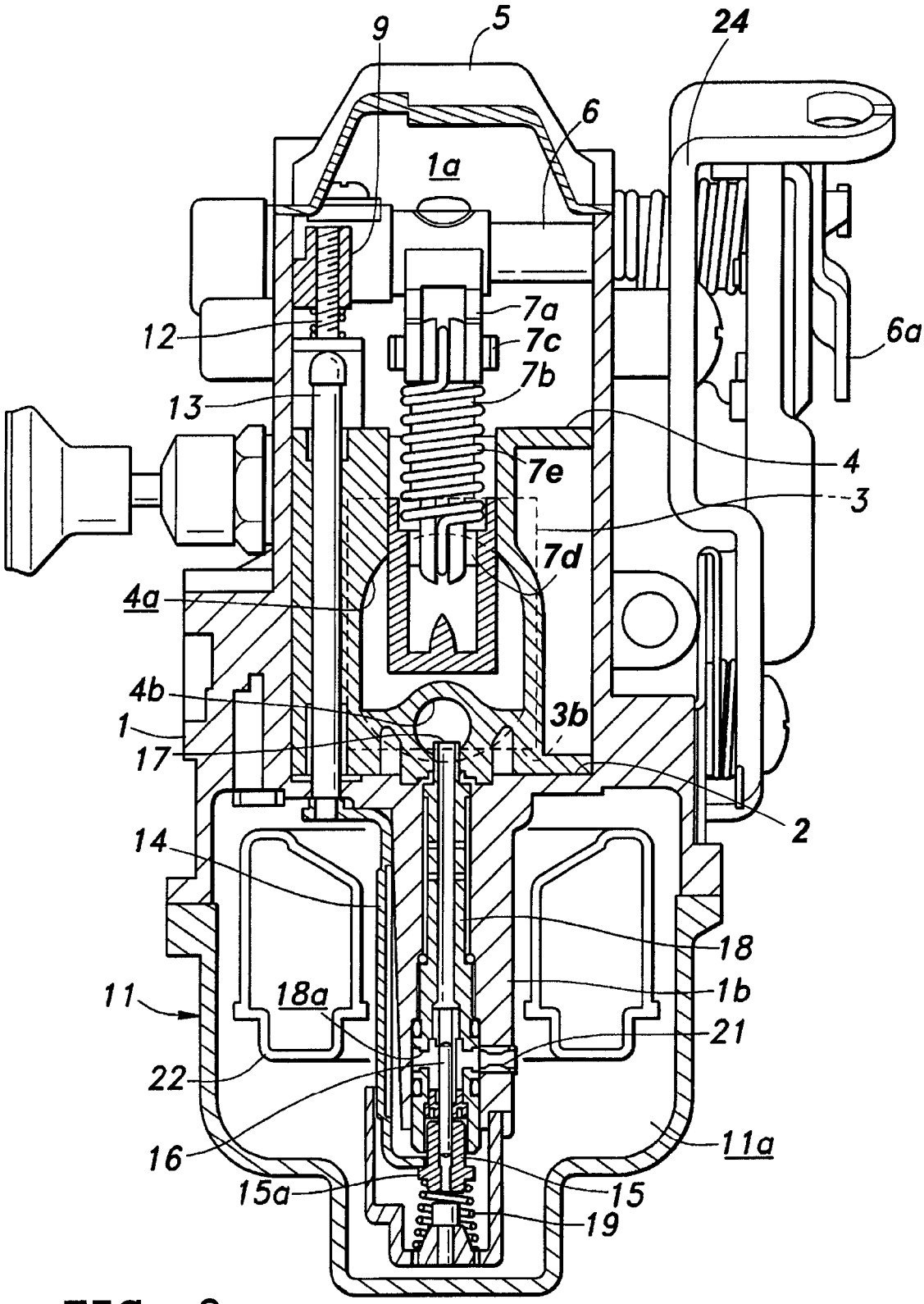
FIG. 2 is a cross-sectional view taken along line II-II in FIG. 1B.

Referring to FIGS. 1B and 2, in an upper part of the carburetor main body 1 a recess 1*a* opens in an upward direction and a cover 5 covers an opening surface of the recess 1*a*. The recess 1*a* and the cover 5 define a space therebetween and this space is adapted to receive the valve member 3 in its valve open state. The space also accommodates a valve member transmission or valve open/close operation means, which moves the valve member 3 and is described below.

A throttle shaft 6 is provided in the recess 1*a* so as to extend in a direction perpendicular to the axis of the intake bore 2 and across the space within the recess 1*a*. Fixed to an end portion of the throttle shaft 6 that protrudes out of the carburetor main body 1 (a right end portion in FIG. 2) is a throttle arm 6*a* that is connected to an external throttle device via a cable (not shown) so that operation of the throttle causes the throttle shaft 6 to rotate around its axis. As shown in FIG. 3, an arrow A indicates a direction of rotation for opening the valve member 3.

Referring to FIGS. 1B and 2, one end of an arm 7*a* extends in a radial direction of the throttle shaft 6 and is fixedly connected to the throttle shaft 6, and the other end of the arm 7*a* is connected to the valve member 3 via a connecting rod 7*b*. The connecting rod 7*b* is coupled to the arm 7*a* via a first pin 7*c* and to the valve member 3 by a second pin 7*d*, wherein a slack adjusting device 7*e*, such as a coiled tension spring, is coupled between the pins 7*c*, 7*d* to take up slack between the arm 7*a* and the valve member 3. Thus, when the throttle shaft 6 is rotated by a throttle operation, the arm 7*a* rotates together and the movement of the arm 7*a* is transmitted to the valve member 3 via the connecting rod 7*b*, whereby the valve member 3 at least partially opens/closes the bore 2.

Although those of ordinary skill in the art will appreciate that there are many ways to adjust a throttle shaft for idle operation, FIG. 1A shows one exemplary idle speed adjustment arrangement. A mounting bracket 24 may be carried by the carburetor main body 1 and may include a flange 24*a* to which is mounted an idle adjuster 25 such as a screw and spring as shown. The idle adjuster 25 cooperates with a flange 6*b* of the throttle arm 6*a*, such that when the idle adjuster 25 is adjusted the throttle arm 6*a* and throttle shaft 6 rotate in the direction of adjustment. Accordingly, an idle position of the valve member 3 may be set by adjusting the idle adjuster 25. FIG. 1B illustrates an exemplary idle position of the valve member 3.

Referring to FIGS. 1B and 2, a fuel supply means such as a fuel bowl or fuel supply adjuster 11 is coupled to a part of the carburetor main body 1 opposite of the recess 1*a* across the intake bore 2. The fuel supply adjuster 11 at least partially defines a fuel reservoir 11*a* to hold fuel. In the illustrated embodiment, the fuel supply adjuster 11 is of a float type in which a float 22 is received in the fuel reservoir 11*a*. The fuel reservoir 11*a* is in flow communication with a fuel tank (not shown) so that an appropriate amount of fuel is supplied to the fuel reservoir 11*a* in response to a position change of the float 22 corresponding to a change in a surface level of the fuel contained in the fuel reservoir 11*a*.

Figure 4:
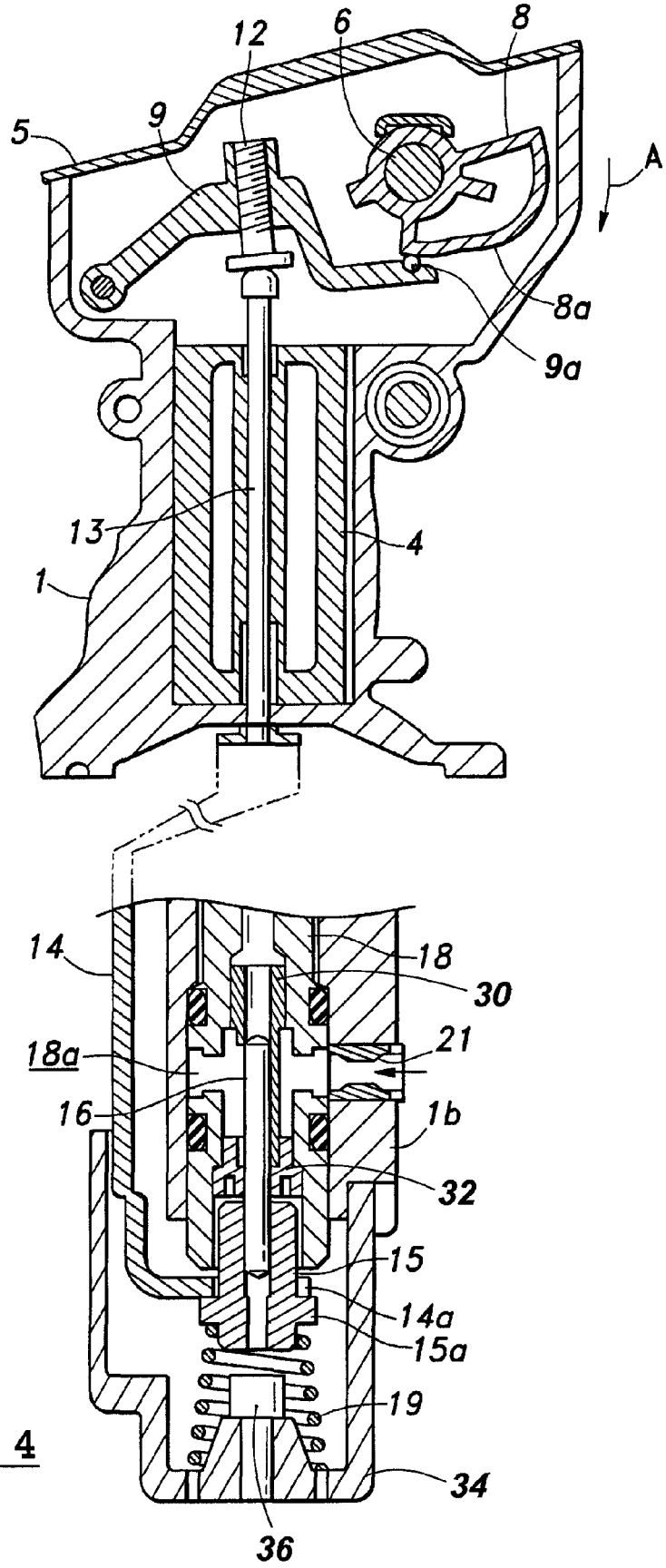
FIG. 4 is a cross-sectional view showing a cam lever portion and the variable fuel jet structure in a closed state.
Figure 5:
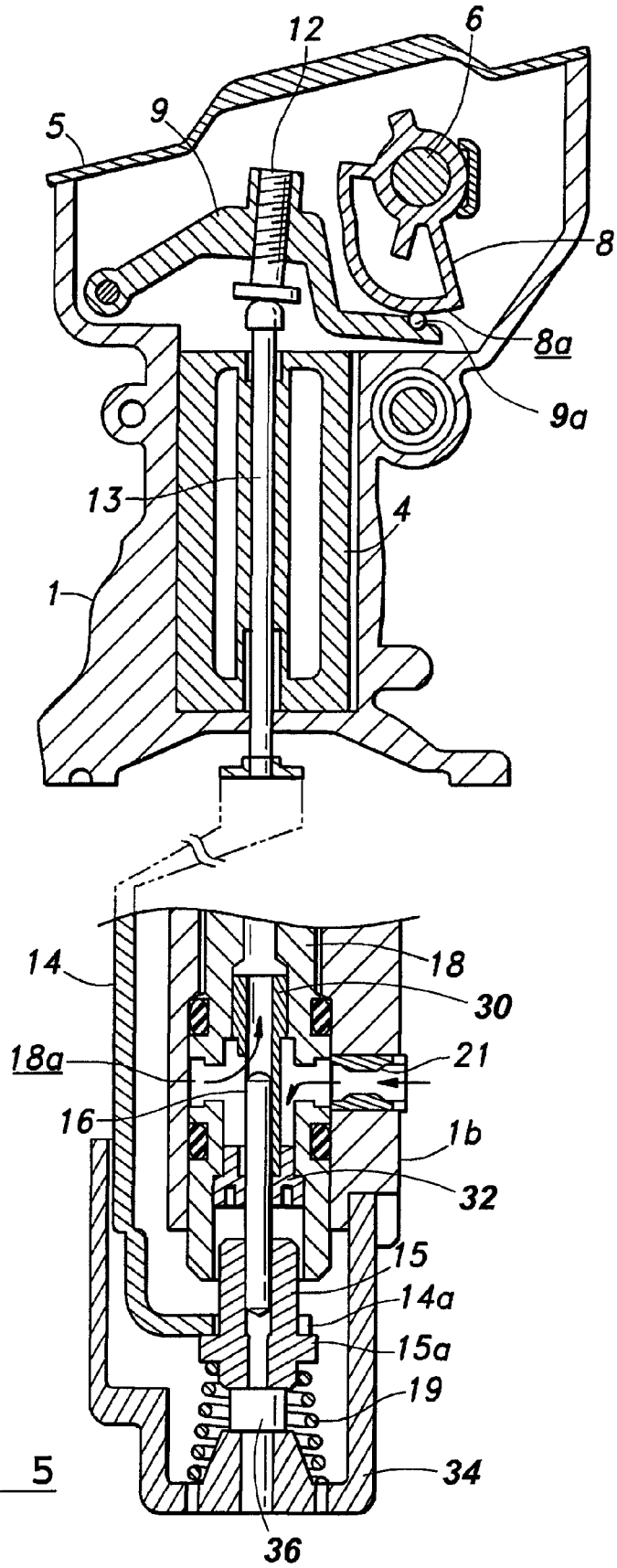
FIG. 5 is a view similar to FIG. 4, but shows the variable fuel jet structure in an open state.

Referring to FIGS. 3 through 5, a fuel supply adjuster may be provided for adjusting the rate at which fuel is supplied from the carburetor according to movement of the valve member 3 caused by operation of the throttle valve member transmission. In this implementation, a fan-shaped cam 8 is secured to the throttle shaft 6 such that the cam 8 rotates with the throttle shaft 6, and a pivot lever or cam lever 9 is pivotably supported on a pin carried by a wall surface that opposes the throttle shaft 6 within the recess 1*a*. A cam surface of the cam 8 is adapted to abut a free end portion of the cam lever 9 at a location spaced from the pivoted end of the lever 9, and the lever 9 is spring-biased in such a direction that the free end portion of the lever 9 is pressed against the cam surface 8*a*. The cam surface 8*a* is designed such that its radius with respect to the throttle shaft 6 increases with a rotation angle toward the fully open position. The cam surface 8*a* may be shaped to at least partially define a variable air-fuel ratio supplied by the carburetor. In other words, the air-fuel ratio of the carburetor may be a function of the shape of the cam surface 8*a*. The free end of the lever 9 may carry a cam contact member 9*a* for reliable contact with the cam surface 8*a* and less sensitivity to manufacturing tolerances compared to contact of the cam 8 and lever 9 alone. For example, the cam contact member 9*a* may be a steel pin, which may be press fit into a corresponding aluminum portion of the lever 9. Also, an adjustment member or mechanism such as a screw 12 is coupled to an intermediate part of the extension of the cam lever 9, which serves as an intermediate moving part of the cam lever 9.

A fuel adjustment rod 13 extends between the recess 1*a* and the fuel reservoir 11*a* of the fuel supply adjuster 11, and an end of the adjustment screw 12 abuts an end of the fuel adjustment rod 13 in the recess 1*a*. The fuel adjustment rod 13 extends through a portion of the valve guide block 4 beside the main intake passage 4*a*, and is supported so as to be moveable in a direction of its extension. An end of the fuel adjustment rod 13 on a side of the fuel reservoir 11*a* is connected to one end of an extension member 14, the other end of which is formed with a fork-shaped engagement portion 14*a* to engage an upper surface of an outer flange 15*a* of a needle support member 15. Thus, the fuel adjustment rod 13 and the extension member 14 constitute an open/close operation amount transmitting mechanism.

The needle support member 15 fixedly holds a base end of a needle valve or member 16. The needle member 16 may have a substantially constant diameter over substantially its entire length. A fuel nozzle outlet or main fuel discharge port 17 of a fuel nozzle or tubular member 18 opens into the venturi 4*b*. The needle support member 15 and needle member 16 are inserted into the tubular member 18 and are supported in such a manner that the needle support member 15 and needle member 16 can move relative to the tubular member 18. The needle member 16 is disposed at a fuel nozzle inlet, which may be substantially opposite of the fuel discharge port 17, to control flow of fuel through the fuel nozzle inlet. A fuel nozzle post or pillar-like boss portion 1*b* (FIGS. 4 and 5) extends from an undersurface of the carburetor main body 1 into the fuel reservoir 11*a*, and the tubular member 18 is concentrically received in the pillar-shaped boss portion 1*b*.

The needle support member 15 is spring-biased, such as by a cone spring 19 interposed between the bottom of the fuel reservoir 11*a* (FIG. 2) and the needle support member 15, in a direction of insertion into the tubular member 18. Thus, the cone spring 19 may also spring-bias the fuel adjustment rod 13 against the adjustment screw 12 at all times so that the fuel adjustment rod 13 can move to follow the movements of the adjustment screw 12 caused by pivoting movements of the cam lever 9. In the fully closed state of the throttle valve 3, the cam lever 9 abuts a part of the cam surface 8*a* having the smallest radius with respect to the throttle shaft 6, as shown in FIG. 4. Because the needle member 16 is spring-biased in a direction of insertion into the tubular member 18 and the needle member 16 is moved against the spring force, the position of the needle member 16 can be prevented from fluctuating, and thus it is possible to achieve highly accurate fuel supply adjustment with a simple structure.

When the throttle is operated toward the fully-open state, the fuel adjustment rod 13 and the extension member 14 move in a direction as indicated by an arrow B in FIG. 3, and the fork-shaped engagement portion 14*a* pushes the outer flange 15*a* in this direction of movement. Therefore, when the throttle is operated toward the fully-open state as shown in FIG. 5, the needle support member 15 is moved to be drawn outwardly from the tubular member 18.

Referring to FIGS. 4 and 5, an exemplary variable fuel jet structure will be described. A portion of the cylindrical wall of the tubular member 18 that overlaps with the upper end portion of the needle member 16 is formed with a passage or annular groove 18*a* such that fuel flow through the annular groove 18*a* can be effectively blocked depending on the position of the needle member 16. In the illustrated embodiment, the annular groove 18*a* is in flow communication with the fuel reservoir 11*a* via a jet 21 provided in a cylindrical wall of the pillar-like boss portion 1*b*. Also, a needle valve seat 30 may be inserted into the inlet end of the tubular member 18, and a seat support 32 may also be inserted into the inlet end of the tubular member 18 to support a free end of the seat 30. The seat 30 may be semi-cylindrical, as shown in FIGS. 4 and 5 to force fuel incoming through the jet 21 to flow around the seat 30 within the groove 18*a* before it flows past the needle member 16 as shown in FIG. 5. In such a structure, depending on the position of the needle member 16, an appropriate amount of fuel in the fuel reservoir 11*a* can be ejected from the main fuel discharge port 17 via the tubular member 18.

As also shown in FIGS. 4 and 5, a nozzle cap 34 may be coupled in any suitable manner to a free end of the nozzle post 1*b*. The nozzle cap 34 may carry a stopper 36 that may be used to limit travel of the needle member 16 by way of the needle support member 15, as best shown in FIG. 5.

Further, as shown in FIG. 1B, a low speed fuel jet 23 is provided between the fuel reservoir 11*a* and the carburetor main body 1. In an idling state of the throttle valve (i.e., the valve member 3 is at the fully-closed position), the fuel supply to the input bore 2 is conducted via the low speed fuel jet 23.

Next, exemplary operation of the carburetor is explained. In the idling state of the carburetor, the fuel supply is conducted through the low speed fuel jet 23 as shown in FIG. 1B. In this state, and as shown in FIG. 2, air flows through one or more gaps between the intake bore 2 and the valve member 3. The air flow rate can be set as a function of distance between a lower end 3*b* of the flat plate portion 3*a* of the valve member 3 and the opposing inner surface of the intake bore 2.

The positional relationship among the component parts constituting the variable fuel jet in the idling state is shown in FIG. 4. Specifically, the extended end of the cam lever 9 abuts a portion of the cam surface 8*a* that has the smallest radius (distance) from the center of the throttle shaft 6, and the fuel adjustment rod 13, the extension member 14 and the needle support member 15 are brought to their highest positions by the spring force of the cone spring 19. Thus, the needle member 16, which is fixed to the needle support member 15 in any suitable manner, is pushed up to the closed position to fully block the flow of fuel through the fuel nozzle inlet.

In a low speed or small opening state where the throttle has been operated in the direction indicated by the arrow A in FIG. 4 so that the valve member 3 is slightly lifted to a position shown by two-dot chain lines in FIG. 3, the valve member 3 exposes only the openings of the venturi 4*b*. Therefore, the air is allowed to flow only through the venturi 4*b* and this can create a strong negative pressure acting upon the main fuel discharge port 17. This can result in favorably vaporized fuel discharged into the intake bore 2 via the venturi 4*b* and, thus, contributes to improving the fuel consumption efficiency and exhaust characteristics.

As mentioned above, in the conventional sliding throttle valve carburetor, a fuel metering needle member, which is called a jet needle, is inserted into the main fuel discharge port that opens into the intake bore, and the needle member is formed with a converging end portion so as to be able to vary an amount of gap between the needle member and the main fuel discharge port to thereby control the amount of fuel discharge. However, in such a structure, the needle member and the main fuel discharge port can contact each other due to engine vibrations or the like, and this can cause abrasion in the needle member and thus result in unfavorable change in the fuel metering characteristics. The change in the amount of fuel discharge can affect the exhaust gas composition and lead to deteriorated exhaust gas characteristics.

With the presently disclosed exemplary embodiments, there may be no jet needle structure (or needle valve) with a needle member having a converging end portion and moved into and out of the main fuel discharge port 17 that opens into the intake bore 2 and, therefore, the above described problem in the conventional carburetor does not arise. Further, in order to cope with problems such as delay in fuel discharge or poor fuel atomization that could be caused due to the absence of the jet needle structure, the carburetor of the exemplary embodiments disclosed herein is equipped with the venturi 4*b* as described above to create a large negative pressure acting upon the main fuel discharge port 17. Specifically, the valve member 3 is adapted to be able to open and close openings at both ends of the venturi 4*b* in the direction of air flow by slidingly moving the flat-plate portions 3*a* along the end surfaces of the venturi 4*b* defining the openings. Such a structure can eliminate an expansion space that would otherwise reduce the flow rate inside the venturi, and thus contribute to creating larger negative pressure acting upon the main fuel discharge port 17.

Further, as to the fuel metering, which could be performed in the conventional embodiment by the jet needle structure constituted by the main fuel discharge port 17 and the needle member inserted therein, the fuel metering is achieved by the tubular member 18 that is in flow communication with the main fuel discharge port 17 and the needle member 16 is inserted into the tubular member 18 from an end on the side of the fuel supply adjuster 11 (i.e., from an end away from the main fuel discharge port 17). The needle member 16 can be reciprocally moved along the tubular member 18 to control the amount of fuel that is supplied from the fuel reservoir 11*a* to the main fuel discharge port 17 via the tubular member 18 with a comparable precision as that of the conventional jet needle structure.

Further, it is now possible to reduce or eliminate inadvertent fluctuation in the fuel flow rate in the jet needle structure that can be attributed to conducting fuel metering at a portion where the air flows at a high speed. Control of fuel supply to the fuel discharge port 17 is achieved by controlling the position of the needle member 16 inserted into the tubular member 18 to vary fuel flow through the fuel nozzle inlet. Thus, the fuel metering can be achieved by using the needle member 16 having a substantially equal diameter substantially over its length, and there is no need to use the conventional jet needle structure. This can eliminate a jet needle structure that may suffer abrasion due to engine oscillations or the like.

In other words, the needle member 16 does not need to have a converging end portion to be inserted into and moved out of the tubular member 18, and can have a same diameter to its tip end as described above. This can prevent collision between the needle member 16 and the tubular member 18 with a substantial space therebetween when applied with engine oscillations and the like. Thus, the carburetor disclosed herein is less likely to suffer deterioration with time unlike the conventional jet needle structure, and hence it is possible not only to improve the fuel consumption efficiency and the exhaust characteristics but maintain the favorable exhaust characteristics without deterioration with time. Nonetheless, another implementation could include a conventionally tapered needle member 16 if desired.

Further, in the fuel metering structure as presently disclosed, the free end of the extension of the cam lever 9 that is away from the pivoted end is adapted to slidably contact with the cam 8, and an intermediate portion of the cam lever 9 is adapted to act upon the fuel adjustment rod 13 via the adjustment screw 12. Therefore, an amount of movement of the fuel adjustment rod 13 is smaller than an amount of corresponding movement of the free end of the cam lever 9. Therefore, the adjustment mechanism is less affected by manufacturing or assembly errors regarding the component parts constituting the valve operation transmitting mechanism. This can improve the accuracy of fuel adjustment effected by the adjustment mechanism and/or the accuracy of position control of the needle member to which the amount of operation of the operating means is transmitted via the adjustment mechanism, even in the case where an amount of fuel discharge is particularly sensitive to a change in a valve opening area. In the above structure, the fuel increase/decrease characteristics can be freely altered by changing the cam shape, and therefore, the design change in accordance with the engine characteristics can be achieved easily.

The adjustment screw 12 transmitting the movement of the cam lever 9 to the fuel adjustment rod 13 is placed in the recess 1*a*. Thus, just by detaching the cover 5, one can access the adjustment screw 12 and rotate it to adjust the relative position of the fuel adjustment rod 13 or the needle member 16 with respect to the valve member 3. This allows an easy adjustment of fuel flow rate even after assembly of the apparatus.

It should be also noted that the fuel adjustment rod 13 is disposed inside of the carburetor main body 1. This eliminates a need for an additional protective structure against an abrupt external force as well as an additional dustproof structure, which would be required and complicate the structure if the fuel adjustment rod 13 were provided outside of the carburetor main body 1. Nonetheless, the rod 13 may be disposed partially or completely outside of the main body 1, if desired.

In the illustrated embodiment, the adjustment screws 12 and the fuel adjustment rod 13 abut each other. The spring-biasing force acting upon the needle support member 15 also pushes the fuel adjustment rod 13 and the extension member 14, which engages the needle support member 15, against the adjustment screw 12. Therefore, though the fuel adjustment rod 13 is not fixedly connected to the adjustment screw 12, the fuel adjustment rod 13 can follow the movements of the adjustment screw 12 in the direction of spring-biasing force without rattling. Further, the total length of the fuel adjustment rod 13 and the extension member 14 can be adjusted by using an insertion bush, and it is possible to press-fit an insertion bush to the fuel adjustment rod 13 by using a jig, for example, to thereby improve the assembly accuracy.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A carburetor, comprising:

a main body defining a bore extending along an axis;

a main passage defined within the bore;

a venturi defined within the bore;

a fuel nozzle carried by the main body and including a fuel nozzle outlet in fluid communication with the venturi; and a valve member translatable with respect to the axis of the bore of the main body to control both an open area of the bore and an open area of the venturi, such that in a closed state, the valve member closes the main passage but maintains the venturi partially open to allow an amount of air for engine idling to flow therethrough and in a fully open state both opens the bore for air flow therethrough and fully opens the venturi for air flow therethrough.

2. The carburetor of claim 1, further comprising:

a throttle shaft carried by the main body;

a fuel bowl carried by the main body and defining a fuel reservoir;

the fuel nozzle including a fuel nozzle inlet in fluid communication with the fuel reservoir;

a needle valve disposed at the fuel nozzle inlet to variably control flow of fuel through the fuel nozzle inlet; and a needle valve transmission coupled between the throttle shaft and the needle valve to convert rotation of the throttle shaft to translation of the needle valve.

3. The carburetor set forth in claim 2 wherein the main body includes a fuel nozzle post in fluid communication with the fuel reservoir and carrying the fuel nozzle.

4. The carburetor set forth in claim 3, further comprising a nozzle cap coupled to the nozzle post and carrying a stopper to limit travel of the needle valve.

5. The carburetor set forth in claim 2, wherein the needle valve transmission includes:

a cam coupled to the throttle shaft; and a linkage operatively coupled to the cam and to the needle valve and extending through the carburetor.

6. The carburetor set forth in claim 5, wherein the cam includes a cam surface shaped to at least partially define a variable air-fuel ratio supplied by the carburetor.

7. The carburetor set forth in claim 2 wherein a portion of the fuel nozzle is formed with a groove that is opened and closed to fluid flow therethrough depending on the translational position of the needle valve within the fuel nozzle.

8. The carburetor set forth in claim 2 wherein the needle valve has a substantially constant diameter from one end to another.

9. The carburetor of claim 2, further comprising:

a throttle shaft carried by the main body;

a needle valve operatively coupled to the fuel nozzle to variably control flow of fuel through the fuel nozzle; and a needle valve transmission coupled between the throttle shaft and the needle valve to convert rotation of the throttle shaft to translation of the needle valve, wherein the transmission includes a cam coupled to the throttle shaft and having a cam surface that at least partially defines a variable air-fuel ratio supplied by the carburetor.

10. A carburetor, comprising:

a main body defining a bore extending along an axis;

a main passage defined within the bore;

a venturi defined within the bore;

a fuel nozzle carried by the main body and including a fuel nozzle outlet in fluid communication with the venturi;

a valve member translatable with respect to the axis of the bore of the main body to control an open area of the bore, such that in a closed state, the valve member closes the main passage but maintains the venturi at least partially open to allow an amount of air for engine idling to flow therethrough; and the valve member includes a wall portion disposed so as to move in slidable contact with end surfaces of the venturi defining openings of the venturi.

11. The carburetor set forth in claim 10, wherein the valve member includes a pair of walls connecting the wall portion such that the valve member has a generally H-shaped cross-section with a central hollow portion.

12. A carburetor, comprising:

a main body defining a bore extending along an axis;

a main passage defined within the bore;

a venturi defined within the bore;

a fuel nozzle carried by the main body and including a fuel nozzle outlet in fluid communication with the venturi;

a valve member translatable with respect to the axis of the bore of the main body to control an open area of the bore, such that in a closed state, the valve member closes the main passage but maintains the venturi at least partially open to allow an amount of air for engine idling to flow therethrough; and a valve member guide block carried by the main body across the bore to support the valve member and defining the main passage and the venturi.

13. A carburetor, comprising:

a main body defining a bore extending along an axis;

a main passage defined within the bore;

a venturi defined within the bore;

a fuel nozzle carried by the main body and including a fuel nozzle outlet in fluid communication with the venturi;

a valve member translatable with respect to the axis of the bore of the main body to control an open area of the bore, such that in a closed state, the valve member closes the main passage but maintains the venturi at least partially open to allow an amount of air for engine idling to flow therethrough; and a valve member transmission, including:

a shaft extending through the main body;

a throttle lever coupled to the shaft external of the main body;

an arm coupled to the shaft; and a connecting rod coupled to the arm and to the valve member, wherein throttle operation moves the throttle lever to rotate the shaft, which rotates the arm and moves the valve member via the connecting rod.

14. The carburetor set forth in claim 13, wherein the valve member transmission further includes a slack adjusting device coupled between the valve member and the arm.

15. The carburetor set forth in claim 14, wherein the slack adjusting device is a coiled tension spring coupled between pins, which couple the connecting rod to the arm and to the valve member.

16. The carburetor set forth in claim 14, further comprising an idle adjustment device carried by the main body and coupled to the throttle lever to adjust an idle position of the valve member.

17. A carburetor, comprising:

a main body defining a bore extending along an axis;

a main passage defined within the bore;

a venturi defined within the bore;

a fuel nozzle carried by the main body and including a fuel nozzle outlet in fluid communication with the venturi;

a valve member translatable with respect to the axis of the bore of the main body to control an open area of the bore, such that in a closed state, the valve member closes the main passage but maintains the venturi at least partially open to allow an amount of air for engine idling to flow therethrough;

a throttle shaft carried by the main body;

a fuel bowl carried by the main body and at least partially defining a fuel reservoir;

a needle valve disposed at a fuel nozzle inlet of the fuel nozzle to variably control flow of fuel through the fuel nozzle inlet; and a needle valve transmission for converting rotation of the throttle shaft to translation of the needle valve to adjust an amount of fuel supply according to movement of the valve member.

18. The carburetor set forth in claim 17, wherein the needle valve transmission includes:

a cam coupled to the throttle shaft;

a needle support member carrying the needle valve;

a linkage operatively coupled between the cam and the needle valve and extending through the carburetor, wherein the linkage includes a rod extending through the main body between the recess and the fuel reservoir, and an extension member connected between the rod and the needle support member; and a cam lever pivotally carried by the main body and biased in such a direction so as to maintain contact with the cam and with the linkage.

19. The carburetor set forth in claim 18 wherein a free end of the cam lever slidably contacts the cam and an intermediate portion of the cam lever acts on the rod.

20. The carburetor set forth in claim 19, further comprising an adjustment member coupled to the cam lever for contact with the linkage to allow for adjustment of fuel flow rate after assembly of the carburetor.

21. The carburetor set forth in claim 18, further comprising a spring to bias the needle valve toward a closed position and to bias the linkage against the adjustment member.

22. A sliding throttle valve carburetor, comprising:

a carburetor main body defining an intake bore;

a valve member movable in a direction of a diameter of the intake bore to increase and decrease an open area of the intake bore;

a venturi disposed in the intake bore and having a flow passage narrower than the intake bore; and a fuel discharge port that opens into the flow passage of the venturi;

wherein the valve member is integrally provided with a wall portion such that the wall portion moves with the valve member to open and close openings of the venturi, and wherein the wall portion is disposed so as to move in slidable contact with end surfaces of the venturi defining the openings.

23. The sliding throttle valve carburetor according to claim 22, further comprising:

a valve open/close operation means to be operated from outside the carburetor for moving the valve member;

a fuel supply means attached to the carburetor main body to supply fuel to the fuel discharge port; and a fuel supply adjuster for adjusting an amount of fuel supply according to a movement of the valve member caused by an operation of the valve open/close operation means, wherein the fuel supply adjuster comprises:

a fuel reservoir;

a tubular member in fluid communication with the fuel discharge port and having a cylindrical wall provided with a passage open to the fuel reservoir;

a needle member movably inserted into the tubular member such that the needle member can open and close the fuel nozzle inlet depending on a position of the needle member inside the tubular member; and an open/close operation amount transmitting mechanism for transmitting an amount of operation of the valve open/close operation means to the needle member.

24. The sliding throttle valve carburetor according to claim 23, wherein the needle member is spring-biased in a direction of insertion into the tubular member, and in response to a movement of the valve member in a valve opening direction caused by the operation of the valve open/close operation means, the open/close operation amount transmitting mechanism causes the needle member to move in a pull-out direction with respect to the tubular member against the spring force.

25. The sliding throttle valve carburetor according to claim 24, further comprising an adjustment mechanism for adjusting a position of the open/close operation amount transmitting mechanism with respect to the amount of operation of the valve open/close operation means.

26. The sliding throttle valve carburetor according to claim 25, wherein the open/close operation amount transmitting mechanism comprises a cam lever adapted to undergo a pivoting movement in response to the external operation, and wherein the adjustment mechanism is provided at an intermediate moving portion of the cam lever between a pivot point of the cam lever and a part of the cam lever to which the external operation is transmitted.

* * * * *

UNITED STATES PATENT AND TRADEMARK OFFICE

CERTIFICATE OF CORRECTION

PATENT NO. : 7,971,858 B2
APPLICATION NO. : 12/119014
DATED : July 5, 2011
INVENTOR(S) : Toshimasa Takahashi et al.

It is certified that error appears in the above-identified patent and that said Letters Patent is hereby corrected as shown below:

Column 10, Line 41, change “claim 14” to “claim 13”.

Signed and Sealed this
Thirteenth Day of September, 2011

David J. Kappos

David J. Kappos
*Director of the United States Patent and Trademark Office*